US008038216B1

(12) United States Patent
Palmer

(10) Patent No.: US 8,038,216 B1
(45) Date of Patent: Oct. 18, 2011

(54) PORTABLE SEAT FOR A WHEELCHAIR

(76) Inventor: Marjorie H. Palmer, Holdrege, NE (US)

( * ) Notice: Subject to any disclaimer, the term of this patent is extended or adjusted under 35 U.S.C. 154(b) by 18 days.

(21) Appl. No.: 12/583,157

(22) Filed: Aug. 13, 2009

(51) Int. Cl.
*A47C 1/022* (2006.01)

(52) U.S. Cl. ..... 297/337; 297/339; 297/344.17; 297/DIG. 10

(58) Field of Classification Search ..... 297/338, 297/339, 344.17, DIG. 10
See application file for complete search history.

(56) References Cited

U.S. PATENT DOCUMENTS

| | | | | | |
|---|---|---|---|---|---|
| 722,166 | A * | 3/1903 | Taft | 254/8 R |
| 2,678,087 | A * | 5/1954 | McKinley | 248/421 |
| 2,821,242 | A * | 1/1958 | Manegold | 248/421 |
| 3,022,037 | A * | 2/1962 | Stallard | 248/421 |
| 3,250,569 | A * | 5/1966 | Gaffney | 297/330 |
| 3,807,795 | A * | 4/1974 | Weant et al. | 297/330 |
| 5,695,248 | A * | 12/1997 | Bell | 297/344.17 |
| 7,341,310 | B1 * | 3/2008 | Ross | 297/344.17 |
| 2003/0011229 | A1 * | 1/2003 | Bell | 297/344.17 |
| 2006/0087166 | A1 * | 4/2006 | Trippensee et al. | 297/338 |

* cited by examiner

*Primary Examiner* — Peter R. Brown
(74) *Attorney, Agent, or Firm* — Stan Collier, Esq.

(57) ABSTRACT

The portable seat is positioned on the two seat rail tubes of a standard wheelchair with brackets. The seat has a lower frame and an upper frame having four pivoted legs slidably mounted in channels. A horizontal arm connects the two front legs at the lower part thereof and has a pivoting and threaded drive nut. Another horizontal arm connects the two rear legs at the lower part thereof and has a pivoting and threaded drive nut, being oppositely threaded. A drive screw is mounted to both drive nuts and when rotated the legs are pushed together to raise the seat thereon. As an additional feature, a tilt seat section may be attached to the upper frame causing the seat to tilt forward allowing the user too more easily dismount. This feature may be activated when the seat is or is not elevated. Appropriate electronics operates the portable seat.

1 Claim, 9 Drawing Sheets

PORTABLE SEAT FOR A WHEELCHAIR

BACKGROUND OF THE INVENTION

1. Field of the Invention

The present invention relates generally to wheelchairs and scooters, and, more particularly, relates to a seat of a wheelchair or scooter, and, in greater particularity, relates to means for assisting the user to elevate oneself or to assist the user in removing oneself from the seat.

2. Description of the Prior Art

Wheelchairs are very important mobility vehicles for persons having a physical condition where mobility is otherwise limited by physical and/or mental impairment. Wheelchairs are present in great numbers in hospitals, nursing homes, rest homes, and at home. Further, there are many reasons to remove oneself from a seated position: to go to bed, to relieve oneself, to change clothes, to take a shower, for medical examinations, etc.

Wheelchairs come with many options that can greatly affect the price. Simple wheelchairs may cost several hundred dollars, and more fully accessorized wheelchairs may cost up to one thousand dollars. The addition of an electric drive and seat adjustable features to wheelchairs raise the cost to between 5 thousand to 10 thousand dollars. Another related product is called the electric scooter and an electric power chair. The cost of these varies greatly depending on features, but ranges from about 1 thousand to several thousand dollars. The electric scooter may be used outside and inside. The power chair is usually limited to the home.

Wheelchairs vary from simple to complex. A very simple wheelchair is called a transport chair and its main feature is that it is lightweight weighing only about 20 pounds. Rather than having two large wheels, a small wheel is placed on each corner of the frame. The seat is a fabric sling seat and secured to two horizontal seat rail tubes. Two widths are available typically. On more traditional wheelchairs, the end of each seat rail tube is mounted a plastic guide that slides up and down the vertical tubes which form an armrest on the top, that can not be removed. Two crossing pivoted tubes, one end attached to the seat rail tube and the other end to a lower frame tube allow the wheelchair to be folded. It has swing-away footrests. Such a wheelchair is sold by Drive Medical Design and Manufacturing.

A more upscale and traditional wheelchair has removable arm rests, a pair of large wheels in the rear and a pair of small wheels in the front, elevating leg rests, swingaway foot rests, fabric sling seat and back and is illustrated by Probasics Model EC10, for example. Additional features of other wheelchairs would include chrome plating; selection of seat widths, ranging from 18 inches to 26 inches; seat depth of 16 inches; a selection of weight capacity; full length armrests. Two pairs of crossed pivoted tubes support the seat rail tubes. In one wheelchair, the seat rail tube is further mounted to a single vertical sliding tube mounted inside a tube secured to the frame. One pair of crossed tubes is used between the sides. As the wheelchair is folded, the seat rail elevates and one end has a plastic guide that travels along a vertical tube where the seat back is secured.

Electric wheelchairs are significantly more expensive than regular wheelchairs and cost from several thousand up to almost 10 thousand dollars. These wheelchairs further add many additional features not available otherwise. Several example of such are sold by Invacare as Model Formula TRE, by Pride Mobility Products Corp. as the Jazzy 100, and by 21$^{st}$. Century Scientific, Inc., as Model Bounder Plus H-Frame Power. For example, the Bounder comes with a chair seat that can recline, tilt, and elevate. All of these actions are provided by computer controlled electric motors driving crossed tubes under the chair seat. The Invacare model also provides recline, tilt and elevate of the chair seat in various combinations of movement. The elevate mode goes up to 7 inches. The seat fabric in these models are not of the sling design as is typical of the regular wheelchair, but have a cushion mounted in a rigid frame. No model is shown having the ability to just move the seat cushion.

For the user who does not require a wheelchair, but still lacks mobility, the electric scooter is an option. The electric scooter provides a cushioned seat mounted to a frame that includes the backrest. The seat may be adjustable in height, but not with a user on the seat. The seat is pivotally mounted to the seat frame for ease of mounting and dismounting. It further may have armrests that can be folded out of the way. Control of the scooter is through a tiller with handle bars with controls thereon. Typically, the scooter has three wheels with the back pair being driven. Such an electric scooter is sold by Pride Mobility Products Corp. as Model Go-Go Ultra.

In the standard wheelchairs and scooters, no provision is made for assisting the user in standing or being elevated. Several patents do disclose such means, but do not disclose seat controllable devices or any device that is portable from one wheelchair to another for such a purpose.

U.S. Pat. No. 3,985,389 discloses a mechanical/hydraulic elevating means attached to the frame for lifting the wheelchair vertically.

U.S. Pat. No. 4,613,151 discloses an electric wheelchair having the seat attached to four pivoting legs to lower the seat and to raise the seat to a standard position.

U.S. Pat. No. 4,949,408 discloses an electric wheelchair having a movable back and leg rest that allows the wheelchair to be converted to a horizontal bed for transferring the user to a bed.

U.S. Pat. No. 4,993,736 discloses wheelchair with a plurality of inflatable cushions under the seat for raising the seat and back to a higher position as a unit.

U.S. Pat. No. 5,108,202 discloses a wheelchair having a mechanical device for moving a sitting patient to a standing position.

U.S. Pat. No. 5,520,403 discloses a wheelchair having a complex mechanical device for elevating the seat within the wheelchair.

U.S. Pat. No. 5,513,867 discloses a wheelchair having a mechanical device for rotating the seat from the horizontal position to an almost vertical position wherein the user may stand.

U.S. Pat. No. 5,613,697 discloses a wheelchair having four hydraulic lifting devices for lifting the wheelchair to a higher position.

U.S. Pat. No. 6,431,650 discloses a wheelchair having a single hydraulic pump in the center of the seat frame and further having four tube-in-tube corners for allowing the seat to be raised vertically.

U.S. Pat. No. 7,040,641 discloses a user lifting device/hoist attached to the wheelchair, and further has a sliding seat to assist in standing the user.

U.S. Pat. No. 7,165,778 discloses a wheelchair having mechanical means to assist in the standing of a user by slanting and raising the seat.

These patents are incorporated by reference.

Accordingly, there is an established need for an improved mobility device having an optional seat having elevating and tilting features.

SUMMARY OF THE INVENTION

The present invention is directed at an improved seat for a limited mobility vehicle, i.e., a wheelchair or scooter.

The present invention further provides means for using the improved seat on standard non-electric wheelchairs and scooters as well as transferring this improved seat to other similar vehicles.

In operation, the present invention allows the user to elevate oneself, tilt the seat, and use the improved seat on standard wheelchairs.

In the present invention, an improved seat may be attached to standard wheelchairs and scooters with or without the original seat thereon. It further may be used as a standalone seat in regular chairs where additional assistance is needed to elevate and/or tilt the seat. In most standard wheelchairs the sling seats are made of leather-like materials without any additional cushioning thereunder. This allows for the seat to remain when the wheelchair is folded. This type of seat has no special features to provide comfort and protection to the user and when used, the user's rear is basically placed in a sling where the weight of the user is support on the seat in basically two locations.

In the preferred embodiment, a portable inflatable seat is positioned where the original wheelchair seat is mounted to two seat rail tubes. The portable inflating seat has a lower frame upon which are attached four supporting brackets, one pair on each side. Each bracket fits over the seat rail tube in a manner that allows it to be easily removed for folding of the wheelchair. Different brackets may be used when the original seat remains. Upon the top of the lower frame is stack mounted a plurality of box-like inflatable seat bags. An air pump unit with battery is removably attached to the back of the wheelchair. A control unit is also removably attached to the wheelchair and a control box is attached to the armrest and to the control unit. A hose from the air pump unit is attached to the lowest inflatable seat bag. When turned on, the air pump unit will inflate the seat bags to a predetermined pressure based upon the weight of the user. The user will be elevated to a height of about 6 inches or so. A deflate switch on the control box will allow the bags to deflate in a controlled manner. As an additional feature, a tilt seat bag being of predetermined shape and attached to the top of the highest inflatable seat bag can be inflated also causing the seat to tilt forward allowing the user to more easily dismount. A separate control is provided for the tilt seat bag. Attached to the top bag is a cushion mounted to an upper frame that is more appropriately designed to prevent excessive point pressures to the user's rear. The portable inflatable seat may also be used on scooters. If the scooter seat is or is not removed, adjustable straps attached to the lower seat frame may be used to secure the portable inflatable seat thereto.

In an alternative embodiment, a portable seat is positioned where the original wheelchair seat is mounted to two seat rail tubes. The portable seat has a lower frame upon which are attached four brackets, one pair on each side. Each bracket fits over the seat rail tube in a manner that allows it to be easily removed for folding of the wheelchair. Different brackets may be used when the original seat remains. Upon the top of the lower frame are four pivoted legs. Two legs are positioned as a unit on the front and two legs as a unit on the rear of the frame. A horizontal arm connects the two front legs at the lower part thereof and has a pivoting and threaded drive nut. Another horizontal arm connects the two rear legs at the lower part thereof and has a pivoting and threaded drive nut, being oppositely threaded. A drive screw is mounted to both drive nuts and when rotated the legs are pushed apart in the front and rear direction to raise the seat thereon. The legs at the lower part are mounted in channels in the sidewalls of the lower frame to further secure them. The upper part of each leg is pivotally mounted to an upper frame. The drive screw may be turned by hand or by an electric motor through a control unit having a control box mounted on the armrest and a battery for power removably attached to the back of the wheelchair. An elevation control switch is included in the control box attached to the armrest and to the motor control unit. An alternative embodiment may allow the power to be supplied by an A/C source. The user will be elevated to a height of about 6 inches or so. A lowering switch on the control box will allow the lowering of the seat in a controlled manner. As an additional feature, a tilt seat section may be attached to the upper frame causing the seat to tilt forward allowing the user too more easily dismount. This feature may be activated when the seat is or is not elevated. A tilt control switch is provided for the tilt seat feature in the control box. Between the lower and upper frame is mounted a plastic curtain to prevent fingers and other objects from becoming lodged in the mechanical mechanisms. A cushion is mounted to the upper frame that is more appropriately designed to prevent excessive point pressures to the user's rear. The portable seat may also be used on scooters. If the scooter seat is or is not removed, adjustable straps attached to the lower seat frame may be used to secure the portable seat thereto.

An object of the present invention is to provide a portable seat that may be used on wheelchairs, scooters, and chairs.

It is another object of the present invention to provide a portable seat that has independently operated elevating and tilting features.

It is a further object of the present invention to provide a portable seat having a seat surface better adapted for long-term use than a standard upholstered sling seat.

It is still a further object of the present invention to provide a portable seat that is easily removed and attached to a standard wheelchair, for example.

It is yet a further object of the present invention to provide a portable seat that minimizes manufacturing costs.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

The present invention is directed at a portable seat for a limited mobility vehicle.

As a preferred embodiment, the present invention is directed at a portable seating device being inflatable or electro-mechanically driven for use on wheelchairs, scooters, and on other seats where the user needs assistance in being elevated or dismounting.

Figure 1:
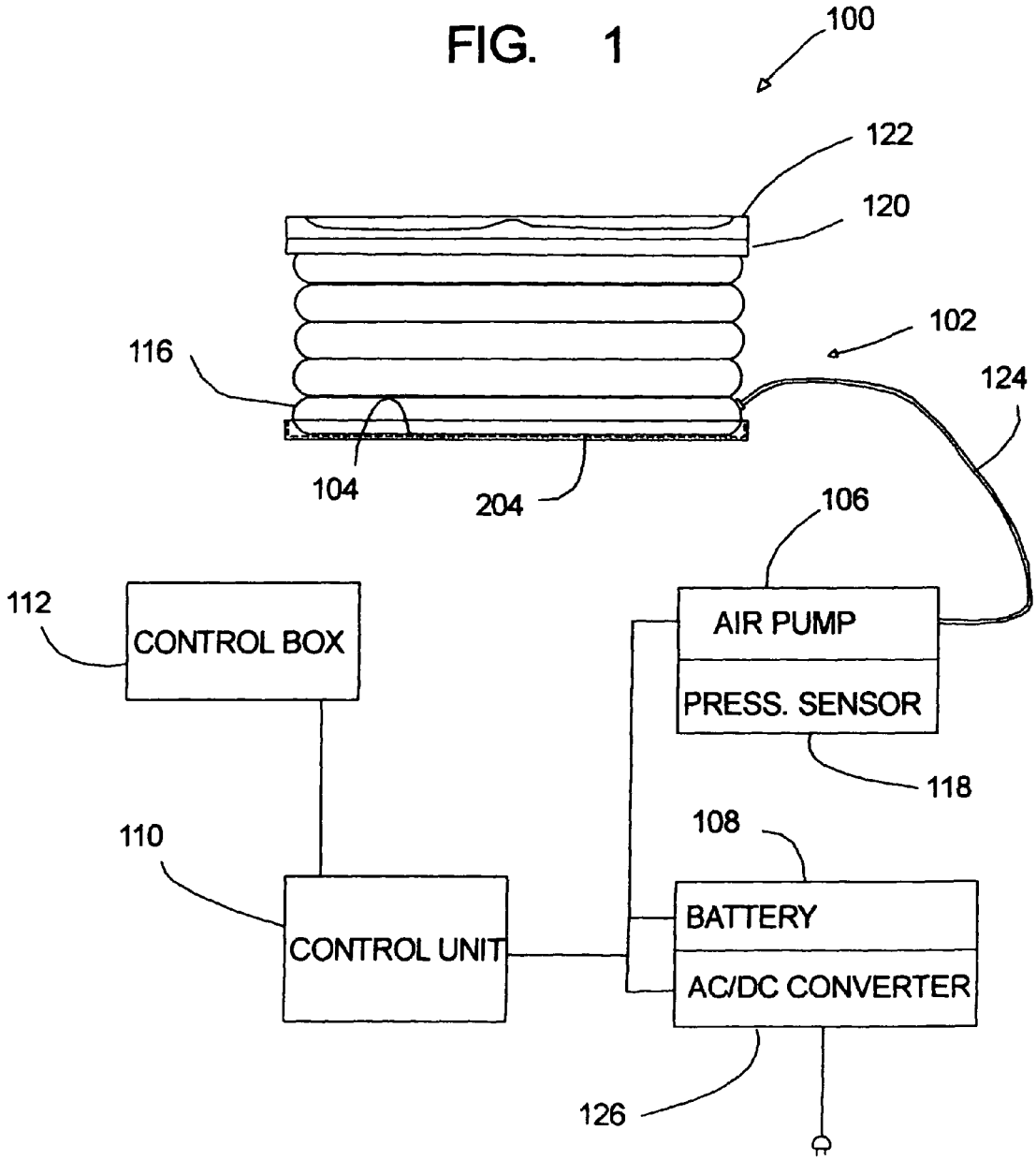
FIG. 1 is a partial schematic view of a portable inflatable seat of the present invention.

Turning to the drawings, wherein like components are designated by like reference numerals throughout the various figures, attention is initially directed to FIG. 1 which illustrates a partial schematic view of a portable inflatable seat 100 constructed according to the present invention.

As best shown in FIG. 1, the portable inflatable seat 100 is inflated by the use of a plurality of stacked rectangular inflatable bags 102. Although other alternative designs may be used, the preferred embodiment is directed at the portable inflatable seat 100 of FIG. 1.

In the present invention, the improved seat may be attached to standard wheelchairs and scooters with or without the original seat thereon. It further may be used as a standalone seat in regular chairs where additional assistance is needed to elevate and/or tilt the seat. In most standard wheelchairs the sling seats are made of leather-like materials without any additional cushioning thereunder. This allows for the seat to remain when the wheelchair is folded. This type of seat has no special features to provide comfort and protection to the user and when used, the user's rear is basically placed in a sling where the weight of the user is support on the seat in basically two locations due to the v-shaped feature of the sling device.

Figure 2A:
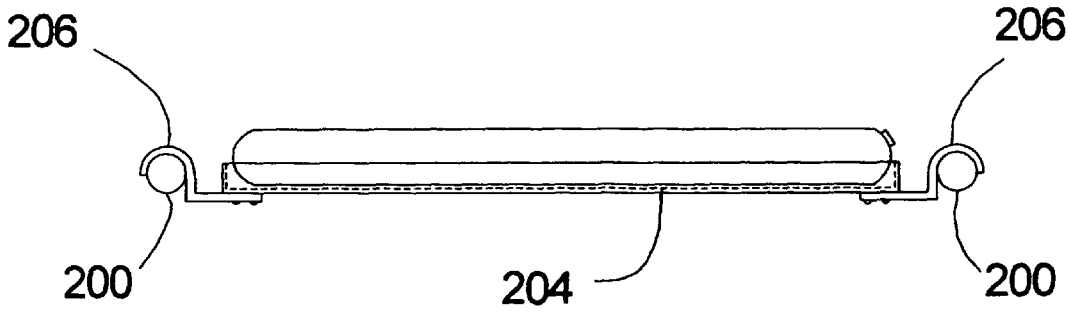
FIG. 2A is a partial front view of a preferred embodiment of a mounting bracket for a portable seat of the present invention.
Figure 2B:
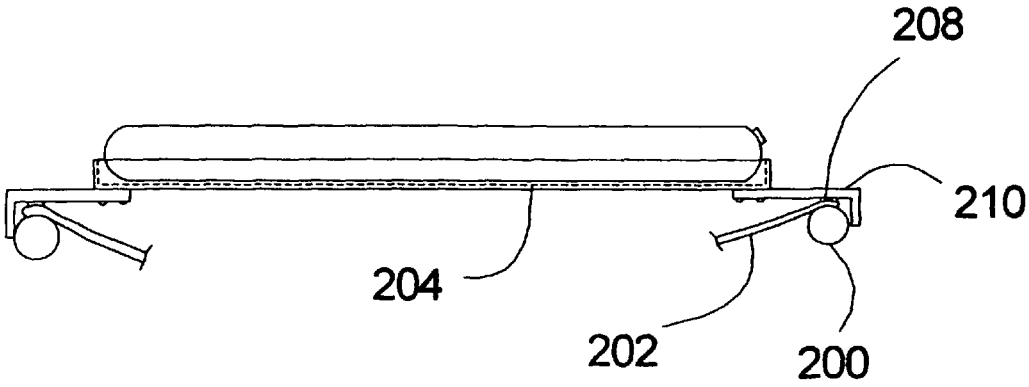
FIG. 2B is a front view of another mounting bracket for a portable seat of the present invention.

In the preferred embodiment, the portable inflatable seat 100 is positioned where the original wheelchair seat 202 is mounted to two seat rail tubes 200, FIGS. 2A and 2B. The portable inflating seat 100 has a lower frame 204 upon which are attached four supporting brackets 206, one pair on each side. The lower frame 204 must be of sufficient strength to support the user resting up it. It may be manufactured of lightweight sheet metal or plastic material. Each bracket 206 fits over the seat rail tube 200 in a manner that allows it to be easily removed for folding of the wheelchair, but still provides sufficient support to the user. Further opposite brackets 206 may further be an integral part of a single strap. As seen in FIG. 2A, the seat 202 has been removed and is normally attached to the seal rail tubes 200 with screws and one or more retainers 208. Different brackets may be used when the original seat remains such as bracket 210 that is L-shaped. Further, these brackets 206 or 210 may be removed and replaced with other types of brackets for holding the seat to a scooter with straps, for example.

Figure 3:
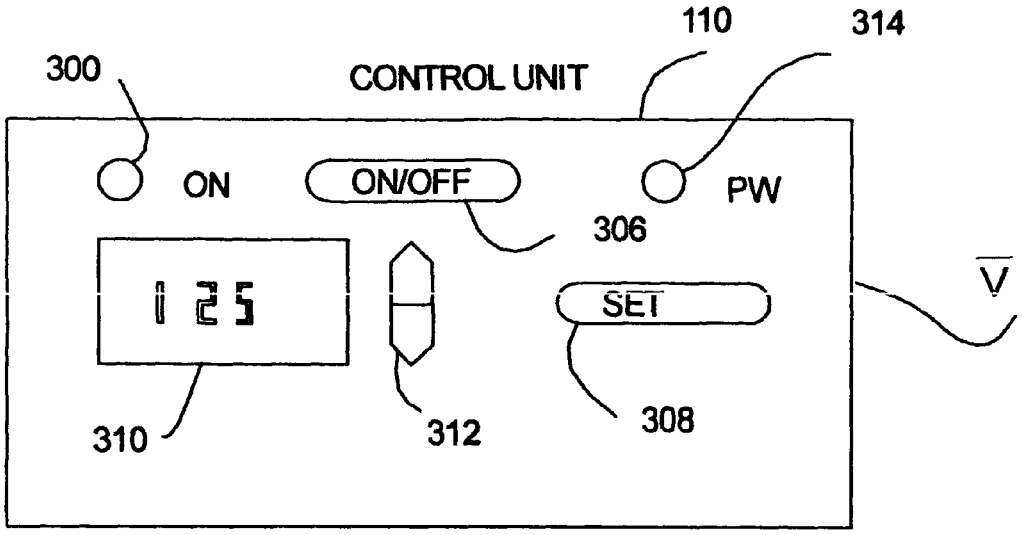
FIG. 3 is a top view of a control unit of the portable inflatable seat of FIG. 2.
Figure 4:
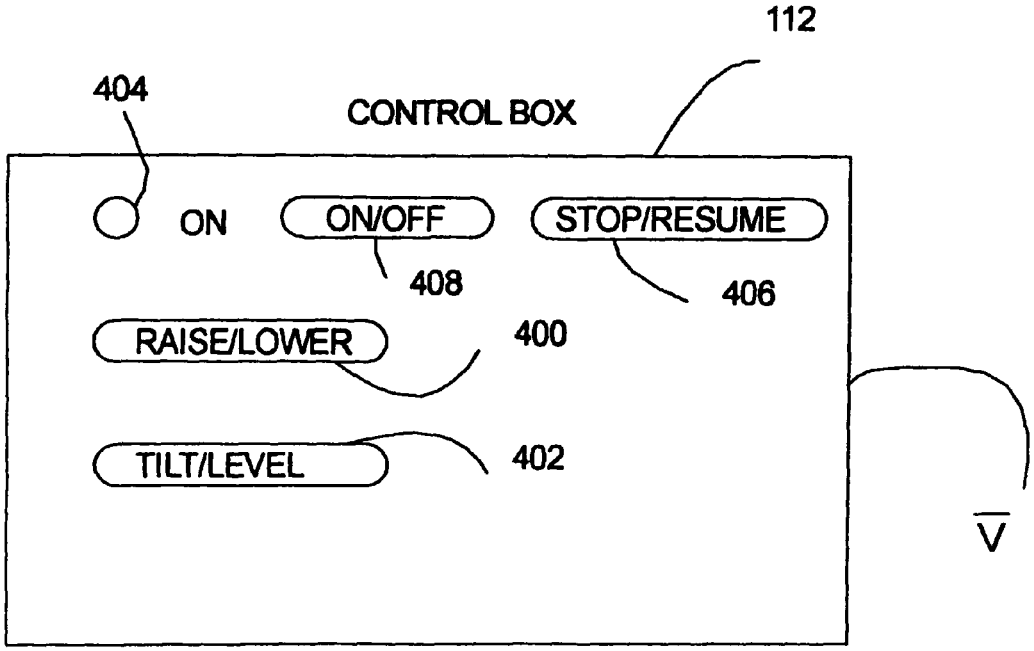
FIG. 4 is a top view of a control box of the portable inflatable seat of FIG. 2.

Upon a top surface 104 of the lower frame 204 is stacked mounted the plurality of box-like inflatable seat bags 102, FIG. 1. These bags 102 may be made of a strong and durable fiber plastic material. An air pump unit 106, being a means of inflating the bags 102 and elevating the lower frame 204, has a battery 108 which may be removably attached to the back of the wheelchair upon one of the vertical tubes, not shown. The air pump unit 106 may be similar to air pumps used to inflate car tires run off of a car battery, for example, and also includes a pressure sensor 118. A control unit 110, FIG. 3, is also removably attached to the wheelchair and a control box 124, FIG. 4, is removably attached to the armrest of the wheelchair and to the control unit 110. A hose 112 from the air pump unit 106 is attached to the lowest inflatable seat bag 116. The pressurized air flowing from one seat bag to the next bag. When turned on, the air pump unit 106 will inflate the seat bags 102 to a predetermined pressure as measured by the pressure sensor 118 in the air pump unit 106 based upon the weight of the user entered into the control unit 110 upon initial setup. The user will be elevated to a height of about 6 inches or so. The backrest of the wheelchair does not move in the present invention.

Referring to FIG. 3, the control unit 110 would include various switches and indicators to operate the portable seat 100. There is mounted therein a pressure sensitive switch 300 to turn the unit on. A green light, an LED, 302 would so indicate the on condition. An off switch 306 with its red LED 304 is mounted therein. A set switch 308 when pressed, for example, would cause an indicator 310 to illuminate. An adjustment switch 312 would be used to enter the weight of the user. If there was insufficient voltage from the battery 108, a red light 310 would blink.

Referring to FIG. 4, an inflate/off/deflate switch 400, three positions, is mounted on the control box 112. This controls the inflation/deflation of the bags 102 in a controlled manner. A green light 404 on the control box 112 indicates that the unit is ready to inflate. All of these devices, switches, indicators, and controls are considered to be conventional and known to one skilled in the art of making control devices for such devices as exercise devices.

Figure 5:
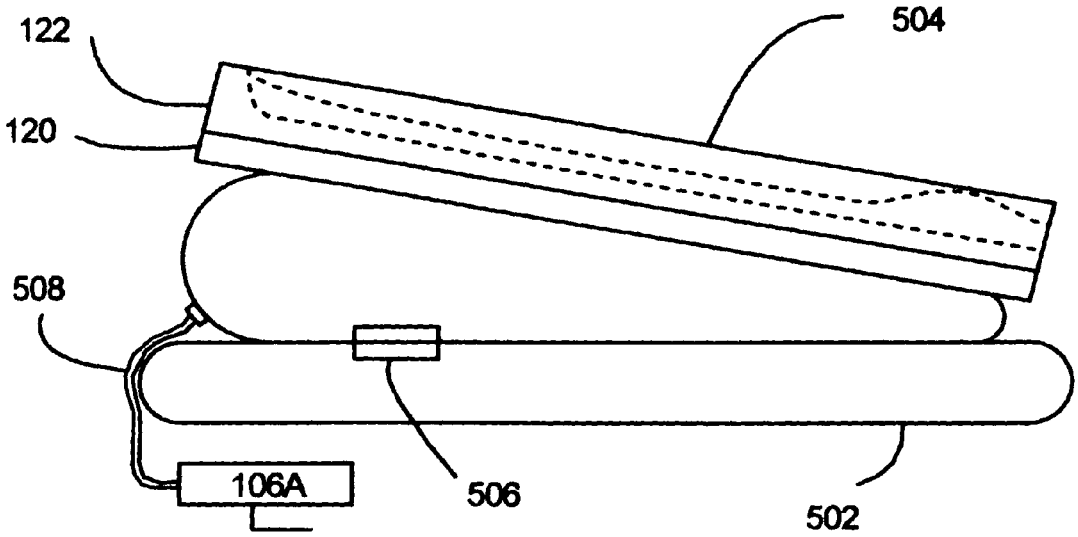
FIG. 5 is a cross sectional side view of a tilting bag portable inflatable seat of the present invention.
Figure 11:
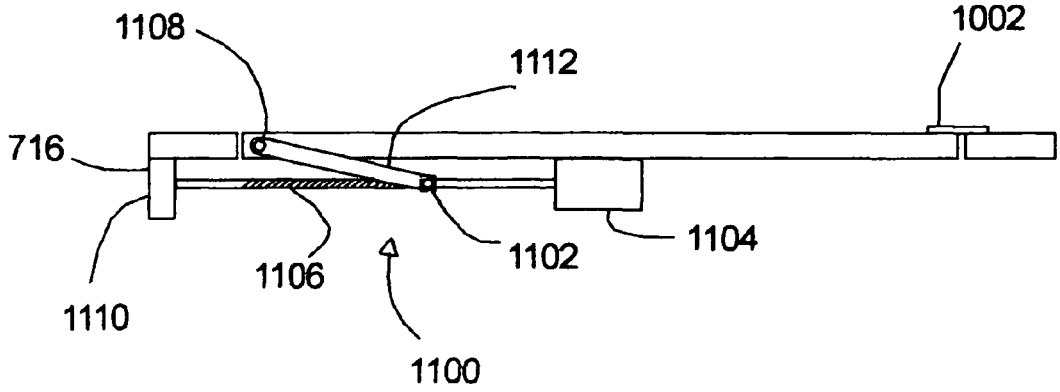
FIG. 11 is a side view of a drive means for opening the tilting seat for a portable seat of the present invention.

As an additional feature a means for tilting of the cushioned seat includes a tilt seat bag 500, FIG. 5, being of predetermined shape and attached to a top of a highest inflatable seat bag 502 that can be inflated causing a seat 504 to tilt forward allowing the user to more easily dismount. The tilt seat bag 500 may be wedge shaped. A pressure-opening-valve 506 may be connected between the bags 502 and 500 so that when a predetermined pressure is obtained in bag 502, the valve 506 will open to allow the pressurized air to flow into the bag 500. It is another further feature to eliminate the valve 506 and attach a separate air hose 508 for operating the tilt seat bag 500 separately and independently from the seat bags below. A separate control switch 402, FIG. 4, is provided for the tilt seat bag 500 on the control box 112. An additional air pump 106A, FIG. 5, and sensor such as shown in FIG. 1 may be used for this purpose, or the switch 402 may further cause a valve to switch the air flow from the air pump 106 to the tilt bag 500. Therefore the user may select the tilt/level function 402 of FIG. 4 on the control box 112 without operating the raise/lower function 400 for the seat bags so that these functions operate independently. Such an air pump and sensor are considered conventional. If the tilt feature is not included, an upper frame 120 is attached to the top bag 502 and a cushion 122 is mounted thereto which is more appropriately designed to prevent excessive pressure to the user's rear. As seen in FIG. 11, a separate electric motor is used to operate the tilt feature of the non-airbag embodiment, and the tilt/level switch 402 may be used to operator the tilt feature independent of the raise/lower switch 400.

Figure 6A:
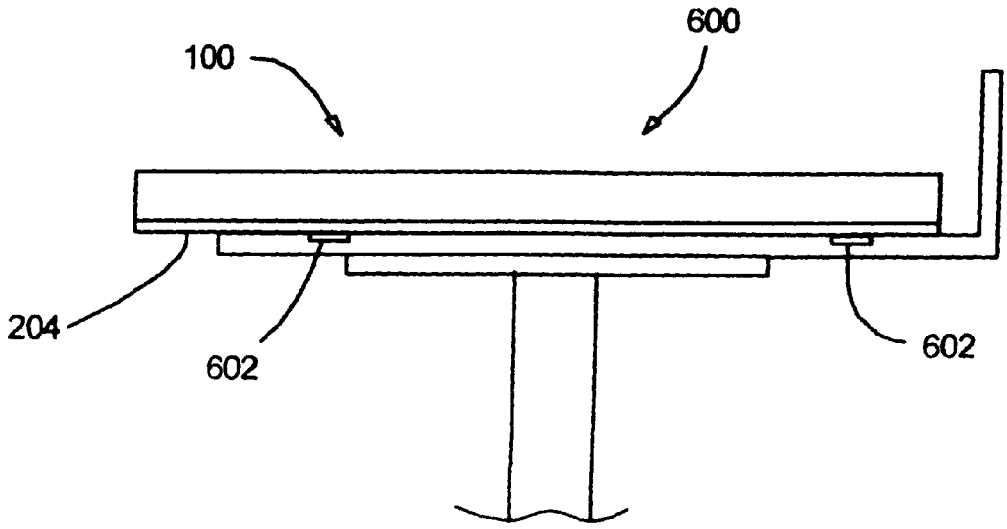
FIG. 6A is a side view of a means for mounting a portable seat of the present invention to an electric scooter
Figure 6B:
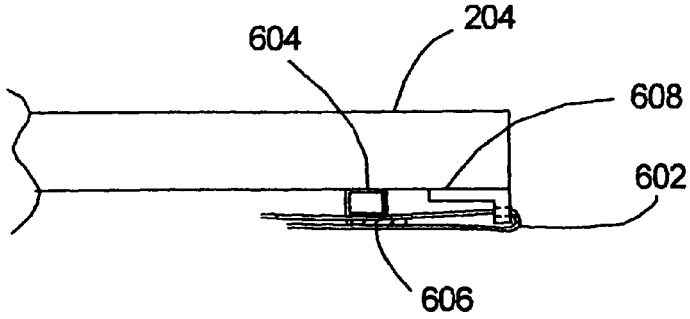
FIG. 6B is a partial front view of a mounting bracket as shown in FIG. 6A for a portable seat of the present invention on an electric scooter.

The portable inflatable seat 100 may also be used on scooters. If a scooter seat 600, partially shown in FIG. 6A, is or is not removed, adjustable straps 602 attached to the lower seat frame 204 may be used to secure the portable inflatable seat 100 thereto. As seen in FIG. 6B, the strap 602 is passed through a bracket 608 and secured by means of a buckle 606 or other means such as a Velcro-like material. The strap 602 would pass over the frame 604 of the scooter seat. If the scooter seat is not removed, the straps 602 must be sufficient secured to prevent the portable inflatable seat from shifting.

Figure 7A:
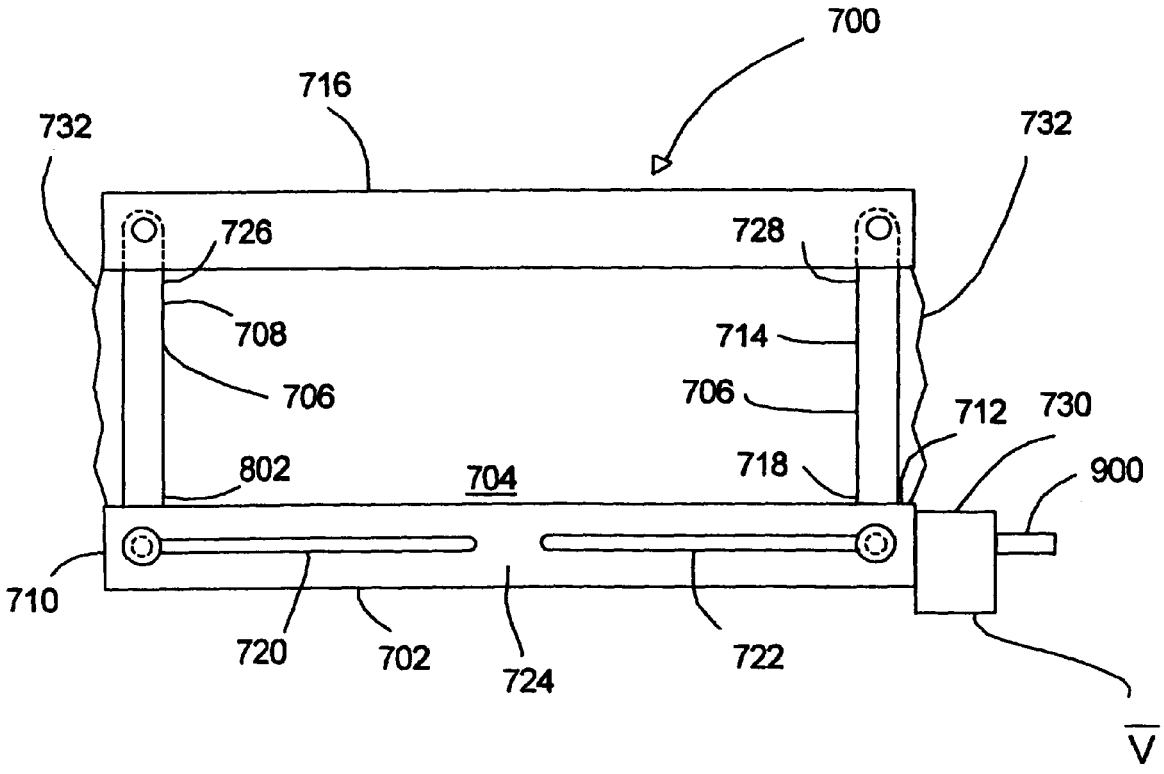
FIG. 7A is a partial side view of a portable seat of the present invention in the elevated position.
Figure 7B:
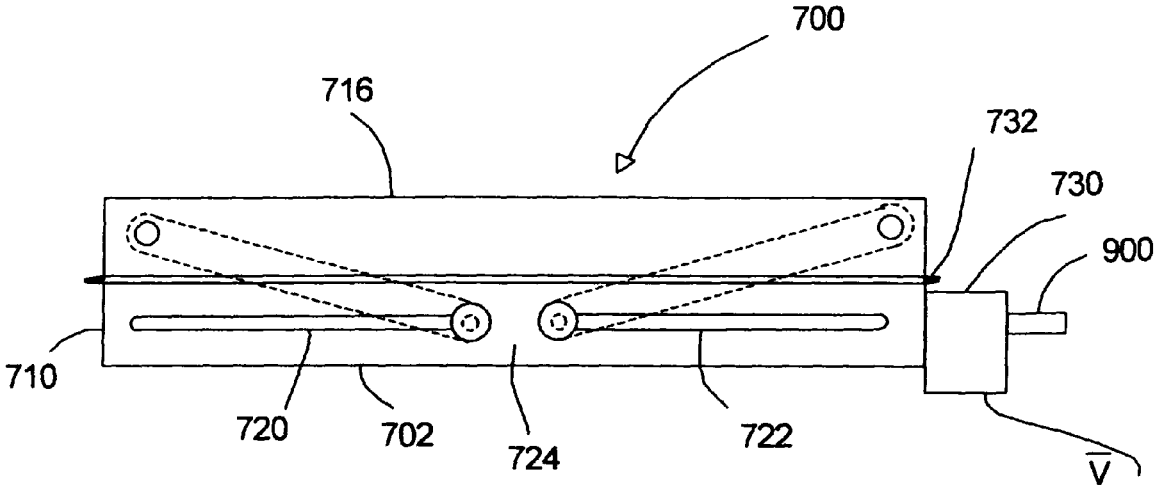
FIG. 7B is a partial side view of a portable seat of the present invention in the non-elevated position.

In an alternative embodiment, a portable seat 700, partially shown in FIG. 7A, is positioned where the original wheelchair seat is mounted to two seat rail tubes. The portable seat 700 has a lower frame 702 that is attached to the wheelchair or scooter in a manner similar to the portable inflatable seat 100 as shown above. FIG. 7A illustrates the seat in the elevated position, and FIG. 7B illustrates the seat in the non-elevated position.

Figure 8:
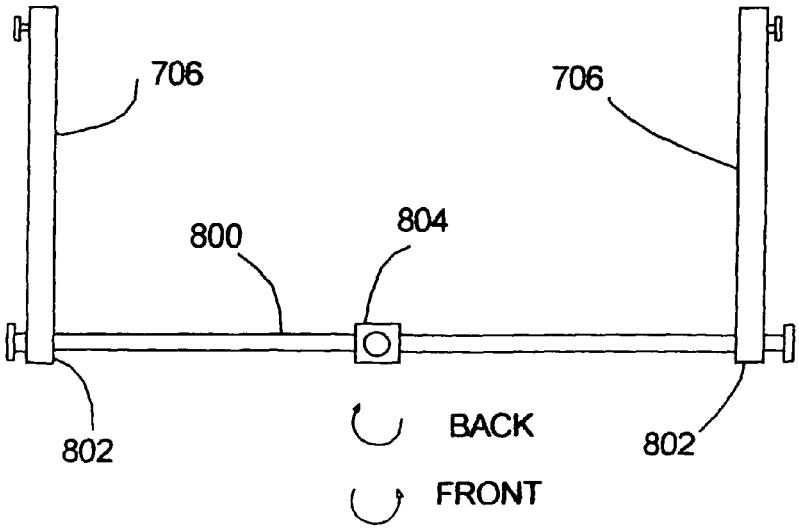
FIG. 8 is a partial front view of a pair of legs with a connecting member between the legs with a drive nut thereon for a portable seat of the present invention.
Figure 9:
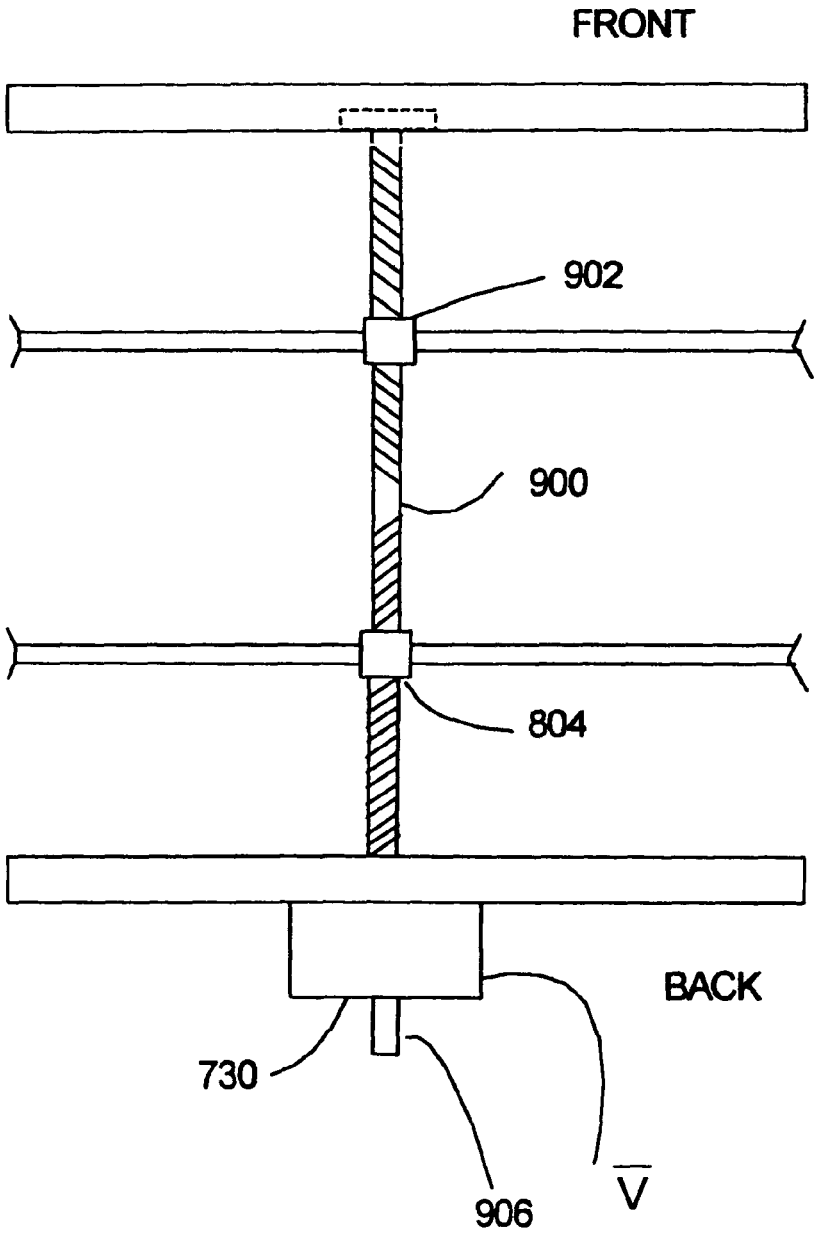
FIG. 9 is a top view of a screw mounted to two drive nuts of the present invention.

Upon a topside 704 of the lower frame 702 are four pivoted legs 706, only two shown from the side. Two legs 708 are positioned on a front 710 and two legs 714 on a rear 712 of the frame 702. The legs 706 are pivotally connected to a top frame 716 at each corner thereof. Referring to FIG. 8, a horizontal arm 800 connects the two front legs 708, for example, at the lower part 802 thereof. The horizontal arm 800 may rotate as mounted therein and has a pivoting and threaded drive nut 804. Another horizontal arm connects the two rear legs 714, not shown, at a lower part 718 thereof and has a pivoting and threaded drive nut 902, being oppositely threaded. Referring to FIG. 9, a drive screw 900 is mounted to both drive nuts 804 and 902, and when rotated the legs are pushed apart in the front and rear direction to raise the seat thereon. As seen therein, the drive screw 900 is oppositely threaded on each half thereof. When in the non-elevated position the drive nuts 804 and 902 are located at the center of the drive screw 900.

Referring to FIG. 7A, the lower legs 718 and 802 are mounted in channels 720 and 722 in the sidewalls 724 of the lower frame 704. The upper part 726 and 728 of each leg is pivotally mounted to an upper frame 716. The drive screw 900 may be turned by hand or by an electric motor 730 through a control unit having a control box mounted on the armrest and a battery for power removably attached to the back of the wheelchair. A raise switch is included in the control box attached to the armrest and to the motor control unit. An alternative embodiment may allow the power to be supplied by an A/C source. The user will be elevated to a height of about 6 inches or so. A lower switch on the control box will allow the lowering of the seat in a controlled manner.

Figure 7C:
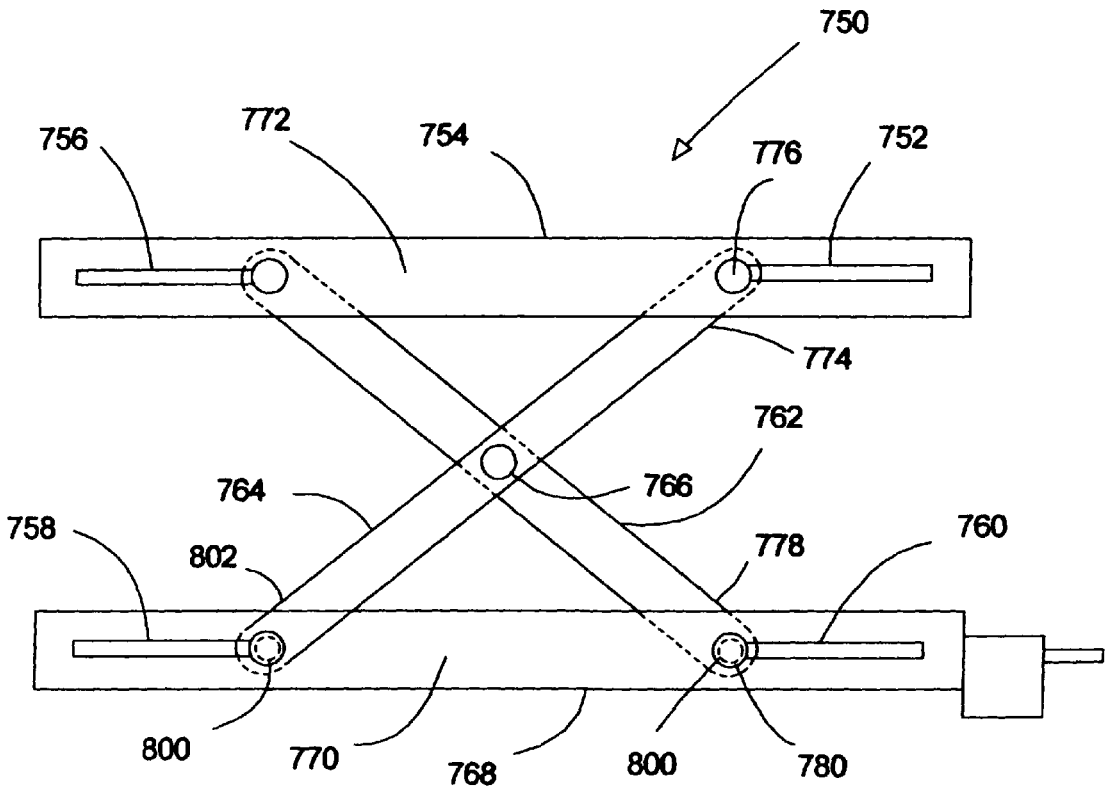
FIG. 7C illustrates by a side view another embodiment of a means for elevating the upper frame of the seat of the present invention.

FIG. 7C illustrates by a side view another embodiment of the means for elevating 750 an upper frame 754. As seen therein, the upper frame 754 and a lower frame 768 have the elevating means 750 mounted thereto. The upper frame 754 and a lower frame 770 have sidewalls 772 and 770, respectively, and are essentially shaped as rectangular open topped boxes constructed of heavy sheet metal, for example. One pair of legs 762 and 764 are shown with a pivot 766 therein. A pair of horizontal slots 752 and 756 are mounted in the sidewall 772. An upper end 774 of leg 764 is mounted in slot 752 with a rivet-like securing means 776 that allows the upper end 774 to slide back and forth in the slot 752. Similar mountings are employed on the other upper ends. A lower end 778 of leg 762 is similarly mounted in slot 760 except the rivet-like securing means 780 is connected by a horizontal arm 800, FIG. 8, to the other leg 762 not shown. The other lower end 802 of leg 764 also has a horizontal arm 800. The means for driving the legs is similar to that shown in FIGS. 8 and 9 except the threading on the drive screw 900 is reversed so that turning in one direction lowers the upper frame 754 by causing the lower ends 802 and 778 to move oppositely and distally in the slots 758 and 760, respectively. Turning in the opposite direction causes the lower ends 802 and 778 to be proximally located as shown in FIG. 7C.

Figure 10:
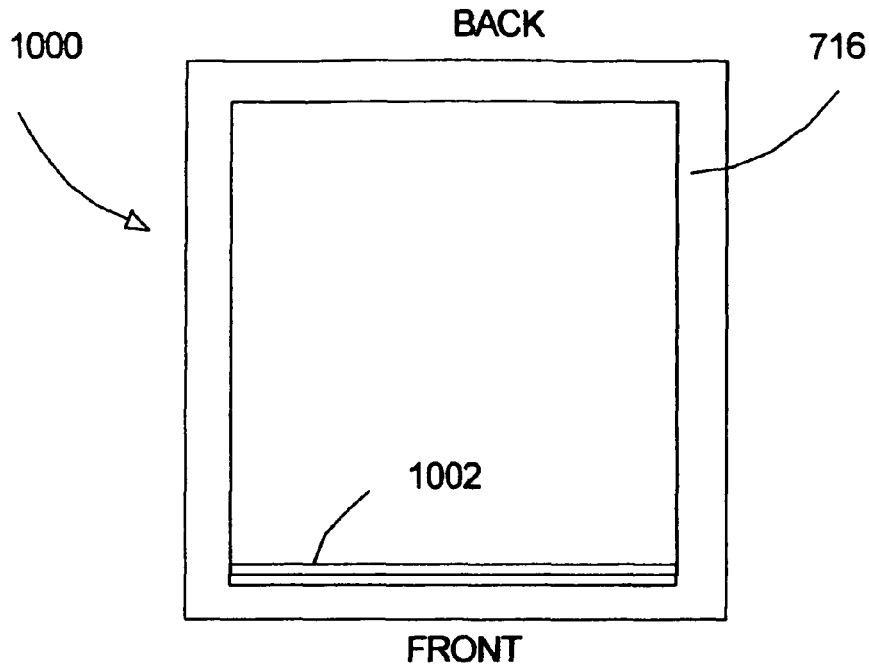
FIG. 10 is a top view of a tilting seat for a portable seat of the present invention.

As an additional feature, a tilt seat 1000, FIG. 10, may be attached to the upper frame 716 causing the seat to tilt forward from a hinged edge 1002 allowing the user too more easily dismount. FIG. 11 illustrates a tilt means 1010 having an electric motor 1004 mounted to the upper frame 716 with a drive screw 1006 having a drive nut 1012 thereon. The drive nut 1012 is rotatably mounted to a lower part 1014 of the arm 1016 that is further pivotally mounted 1018 to the back edge of the tilting seat 1000. This feature may be activated when the seat is or is not elevated. A tilt control switch is provided for the tilt seat feature in the control box.

Between the lower and upper frames 704 and 716, FIG. 1, is mounted a plastic curtain 732 to prevent fingers and other objects from becoming logged in the mechanical mechanisms. A cushion is mounted to the upper frame 716 that is more appropriately designed to prevent excessive pressure to the user's rear as shown above. The portable seat may also be used on scooters. If the scooter seat is or is not removed, adjustable straps attached to the lower seat frame may be used to secure the portable seat thereto.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A portable seat for users having limited mobility, said portable seat for use on wheelchairs for use by single users therein, said portable seat comprising:

a cushioned seat;

an upper frame, said cushioned seat mounted to said upper frame;

means for elevating said upper frame and said cushioned seat, wherein a front pair of legs being connected together by a connecting arm at a lower part thereof, a back pair of legs being connected together by a connecting arm at a lower part thereof, each connecting arm having a drive nut, a screw connected to both of said drive nuts, a first part of said screw having a different thread direction than a second part of said screw wherein a rotation of said screw causes said nuts to move oppositely of each other, said legs being vertically positioned by said screw when said upper frame is fully extended in a vertical direction;

means for tilting the seat cushion, said means for tilting being located in said upper frame, said means for tilting having mechanically driven means attached to said upper frame and a titling seat with said seat cushion thereon, wherein said means for tilting operates independently of the means for elevating;

a lower frame, said means for elevating mounted to said upper frame and said lower frame, said lower frame having removable means for mounting said lower frame to seat rail tubes of the wheelchair with or without a flexible seat thereon; and a power source, said power source driving said means for elevating.

* * * * *